US007017277B1

(12) United States Patent
Adams et al.

(10) Patent No.: US 7,017,277 B1
(45) **Date of Patent: *Mar. 28, 2006**

(54) VACUUM TREATMENT OF AN INPUT STREAM WITHOUT RUINING DELICATE OUTPUT FRACTIONS

(76) Inventors: Randall G. Adams, 1014 W. 52d St., Carthage, MO (US) 64836; Marshall R. Franklin, 1218 County La. 132, Carthage, MO (US) 64836

( * ) Notice: Subject to any disclaimer, the term of this patent is extended or adjusted under 35 U.S.C. 154(b) by 0 days.

This patent is subject to a terminal disclaimer.

(21) Appl. No.: 10/685,343

(22) Filed: Oct. 14, 2003

Related U.S. Application Data

(63) Continuation-in-part of application No. 10/269,920, filed on Oct. 12, 2003, now Pat. No. 6,754,978.

(60) Provisional application No. 60/329,089, filed on Oct. 13, 2001.

(51) Int. Cl.
*F26B 13/30* (2006.01)

(52) U.S. Cl. ..... 34/92; 34/361

(58) Field of Classification Search ..... 34/92, 34/361, 362; 426/478, 299, 479, 480, 614; 422/309, 33, 32, 5, 1; 159/2.1, DIG. 16, 159/DIG. 28, 47.3
See application file for complete search history.

(56) References Cited

U.S. PATENT DOCUMENTS

| | | | | | |
|---|---|---|---|---|---|
| 1,945,860 | A | | 2/1934 | Laffler | 426/299 |
| 3,724,090 | A | | 4/1973 | Smith, Jr. | 34/57 D |
| 4,082,856 | A | | 4/1978 | Zwiep et al. | 426/299 |
| 4,191,102 | A | * | 3/1980 | Cope | 99/580 |
| 4,308,290 | A | * | 12/1981 | Fujii | 426/299 |
| 4,731,164 | A | | 3/1988 | Williamson | 202/173 |
| 4,738,779 | A | | 4/1988 | Carroll et al. | 210/512.2 |
| 5,053,238 | A | * | 10/1991 | Zeidler et al. | 426/299 |
| 5,129,993 | A | | 7/1992 | Bleeker | 159/47.3 |
| 5,185,087 | A | | 2/1993 | Lister et al. | 210/787 |
| 5,421,645 | A | | 6/1995 | Young | 312/108 |
| 5,429,750 | A | | 7/1995 | Steele | 405/129.95 |
| 5,462,661 | A | | 10/1995 | Nasu | 210/774 |
| 5,507,958 | A | | 4/1996 | White-Stevens | 210/774 |
| 5,772,901 | A | | 6/1998 | Yu et al. | 210/138 |
| 5,951,947 | A | | 9/1999 | Hunt | 422/21 |
| 6,052,917 | A | | 4/2000 | Matsumoto | 34/138 |
| 6,056,885 | A | | 5/2000 | Wasinger | 210/760 |
| 6,176,376 | B1 | | 1/2001 | MacNeil | 209/510 |
| 6,344,217 | B1 | * | 2/2002 | Ruepp | 424/581 |
| 6,454,907 | B1 | | 9/2002 | Erdman | 203/1 |
| 6,649,203 | B1 | * | 11/2003 | Thoroski | 426/299 |

* cited by examiner

*Primary Examiner*—Henry Bennett
*Assistant Examiner*—Camtu Nguyen
(74) *Attorney, Agent, or Firm*—Jonathan A. Bay

(57) ABSTRACT

A method of separating the membrane and mineral fractions from an input stream of broken empty egg shells comprises a vacuum treatment to promote the membrane fraction to "eject" or detach from the attached or adhered scraps of mineral, ie., mineral shards or powder. A main processor operates at a level of vacuum that determines a given boiling temperature for water, and one which lower than water's boiling temperature for the local vicinity's barometric pressure (eg., atmospheric pressure). The input stream is preheated to above the given boiling temperature for water as determined by the main processor's vacuum level without, however, going over the boiling temperature for the local barometric pressure. It is then introduced into the vacuum of the main processor whereby a small percentage of the water content flashes into steam, and this presumptively promotes membrane matter to eject or detach from the shards or powder of mineral.

24 Claims, 5 Drawing Sheets

VACUUM TREATMENT OF AN INPUT STREAM WITHOUT RUINING DELICATE OUTPUT FRACTIONS

CROSS-REFERENCE TO RELATED APPLICATION(S)

This application is a continuation-in-part of U.S. patent application Ser. No. 10/269,920, filed Oct. 12, 2003 now U.S. Pat. No. 6,754,978, which claims the benefit of U.S. Provisional Application No. 60/329,089, filed Oct. 13, 2001, both of the foregoing being incorporated fully herein by this reference.

BACKGROUND AND SUMMARY OF THE INVENTION

The invention relates to vacuum treatment of an input stream for separation into diverse streams of distinct fractions. More particularly, the invention accomplishes such treatment and separation by various means including without limitation vacuum and heating processes, mechanical processes, as well as without limitation flash-steam production and pneumatic-conveyance drying.

A preferred input material includes without limitation empty broken egg shells, as a by-product of the like from egg-producing or -utilizing operation. It is preferred to separate empty broken egg shells into two fractions, namely a mineral powder in contrast to petals of membrane. Membrane desirably contains, among other constituents, collagen, the protein of connective tissue. The membrane fraction is optimally rendered by the treatment in accordance with the invention to be pathogen free:—that is, not merely allergen free or allergy tested but, even better, pathogen free.

As for terminology, it is preferred to construe "egg shells" as consisting of soft "membrane" and hard "mineral." In other words, it is preferred to avoid confusion between the terms "shell" and the "mineral" by using the term "mineral" as the counterpart of "membrane" in the twosome of "mineral" and "membrane."

Abundant supplies of fresh and uncontaminated, broken empty egg shells are readily available from various sources including without limitation large-scale foodstuff industries which are predominantly interested only in the albumen (white) and yolk. In such large-scale operations, the empty broken eggshells are an un-used or under-utilized by-product thereof. It is an object of the invention to improve utilization of such.

It is another object of the invention to input a continuous stream of broken empty egg shells and separate such into a soft membrane fraction as well as, in contrast, a hard mineral fraction. In terms of the soft membrane fraction, it is more accurate to say that an avian egg has both an inner and outer membrane layer, which among other things are divided where they line the air cell in the bulbous end of an egg. However, for purposes of this description, the membrane fraction of empty broken egg shells will be predominantly treated as one thing, and without more technically accurately distinguishing between inner and outer layers thereof.

It is preferred in accordance with the invention to recover the hard mineral fraction in a dry stream of bits or dust, or as another way of reckoning things, a powder. In contrast, it is preferred in accordance with the invention to recover the soft membrane fraction in a stream of flakes or shreds which for convenience of this written description and without limiting the invention are hereafter referred to as "petals." The term "petal" is no term of art but instead is adopted in view of that at least one preferred texture for the output stream of the membrane fraction can be reckoned to something in ordinary experience as most likely approximating fresh rose petals.

One aspect of the invention is to gain control over textural and structural changes to the membrane fraction as it undergoes the method in accordance with the invention. Underneath a scanning microscope, fresh membranes can be resolved into a feltwork of interlacing fibers of variable diameter. S. E. Solomon, *Egg and Eggshell Quality*, p. twenty-two (Iowa State Univ. Press 1997). The membrane fibers comprise a fairly simple arrangement of protein and carbohydrate (in contrast to albumen which is an admixture of some forty structurally distinct proteins), wherein chemical variation therein is fairly confined to the end portions of the fibers of the outer membrane. Id, p. ninety-three.

It is estimated that about 10% of egg shell membrane weight comprises collagen, the main protein of connective tissue. In general overview of the foregoing, egg shell membrane comprises an organic biochemistry that nowadays is more greatly appreciated for being a source of some highly valuable constituents. It is an object of the invention to separate a membrane fraction from empty broken egg shells without changing (much, if at all) the delicate constituents (eg., molecules and the like), to the extent practicable.

The inventive method and apparatus utilizes in part various heat processes to accomplish drying and/or separation as described more particularly below. However, there are worrisome aspects over what heat will do to the delicate molecules and the like in the membrane, including the protein and connective tissue constituents (it is noted that, while carbohydrates also change with heat they usually can withstand higher temperatures than proteins, and oils can usually withstand higher temperatures still). Simply put, elevated temperatures produce physical changes in proteins and connective tissue. The applicable phenomena are better understood by food scientists, as in more particular connection with foodstuffs, such as cuts of beef. Without knowing for sure, certainly some of the understanding for beef is fairly transferable to egg shell membranes. Hence the following for now is at least more accurate in connection with beef.

Food scientists know that beef-steaks undergo physical changes with temperatures ranging from 54° C. (130° F.) (eg., very rare) to 82° C. (180° F.) (eg., very well done), which corresponds to changes in color from deep red or purple to pale gray. The color changes are a result of the "denaturation" of myoglobin in the beef. Denaturation is the physical unfolding of proteins in response to such influences as extreme heat. The denaturation of myoglobin (eg., a red iron-containing protein pigment in muscles that is similar to hemoglobin) make the protein unable to bind oxygen, causing color change from bright cherry red of oxymyoglobin to the brown of denatured myoglobin (equivalent to metmyoglobin). Ie., The New Encyclopaedia Britannica, Volume 19 of the Macropaedia, the entry under "Food Processing," p. three-hundred eighty-one (® 2002).

In regards of structural changes, the color changes seen during the cooking of beef correspond to structural changes also taking place. The structural changes are due to the effects of heat on collagen (again, connective tissue proteins) and actin and myosin (myofibrillar proteins). In the temperature range between 50° C. and 71° C. (122° F. and 160° F.) connective tissue in meat begins to shrink. Further heating to temperatures above 71° C. causes the complete denaturation of collagen into a gelatin-like consistency. As an aside, that circumstance leads to cooks cooking tough meats, which have relatively high amounts of connective tissues, slowly under moist conditions to internal temperatures above 71° C., so that a tough meat is tenderized by the fact of gelatinization of the collagen while at the same time the moist conditions maintain juiciness.

The myofibrillar proteins also experience major changes during cooking. In the range of 40° C. to 50° C. (104° F. to 122° F.) actin and myosin begin to lose solubility as heat denaturation begins. At temperatures of 66° C. to 77° C. (150° F. to 170° F.) the myofibrillar proteins begin to shorten and toughen. Beyond 77° C. (170° F.) proteins begin to lose structural integrity (ie., they are completely denatured) and, at least for the sake of culinary arts, tenderness begins to improve. And so in general, meats with low amounts of connective tissue are most tender when served closer to medium rare or rare so that muscle proteins are not hardened. Conversely, meats with heavy amounts of connective tissue require slow cooking closer to well done in order to achieve collagen gelatinization.

It is not known how much of the foregoing is applicable to the issues surrounding heat and egg shell membrane. Nevertheless, moderate heat will certainly cause egg shell membrane to shrink and toughen, although extreme heat will not as much as gelatinize membrane but instead turn it to ash. It is an object of the invention to minimize or manage change to the membrane fraction, if not eliminate such change altogether. Users of the inventive method and apparatus will at times desire a membrane output whose texture most closely resembles fresh rose petals. Perhaps this texture might correspond to something like what?, "very rare" or "rare?" At other times, an acceptable texture might be slightly shrunken and tougher. Perhaps that texture might correspond to what?, medium? It is generally not preferred to crisp the membrane fraction to the point of becoming something like a breakfast cereal flake, ie., a Post® Toasties® or Kellogg's® Corn Flakes®. Indeed, it is strictly not preferred to turn the membrane to ash.

It is an object of the invention to improve utilization of a common by-product large-scale foodstuff or egg-laying operations, namely broken empty egg shells.

It is another object of the invention to separate a continuous input stream of broken empty egg shells into at least two output fractions, ie., a soft membrane fraction as well as, in contrast, a hard mineral fraction.

It is an additional object of the invention to separate a membrane fraction from empty broken egg shells without changing (much, if at all) the membrane fraction's delicate constituents (eg., molecules and the like), to the extent practicable.

It is an alternate object of the invention is to gain control over textural and structural changes to the membrane fraction as it undergoes the treatments pursuant to the method in accordance with the invention.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIGS. 1A and 1B tile together to form a block diagram of a method and apparatus in accordance with the invention for accepting an input stream of, for example, empty broken egg shells and separating such into membrane and mineral fractions and respectively;

DETAILED DESCRIPTION OF THE PREFERRED EMBODIMENTS

Figure 1A:
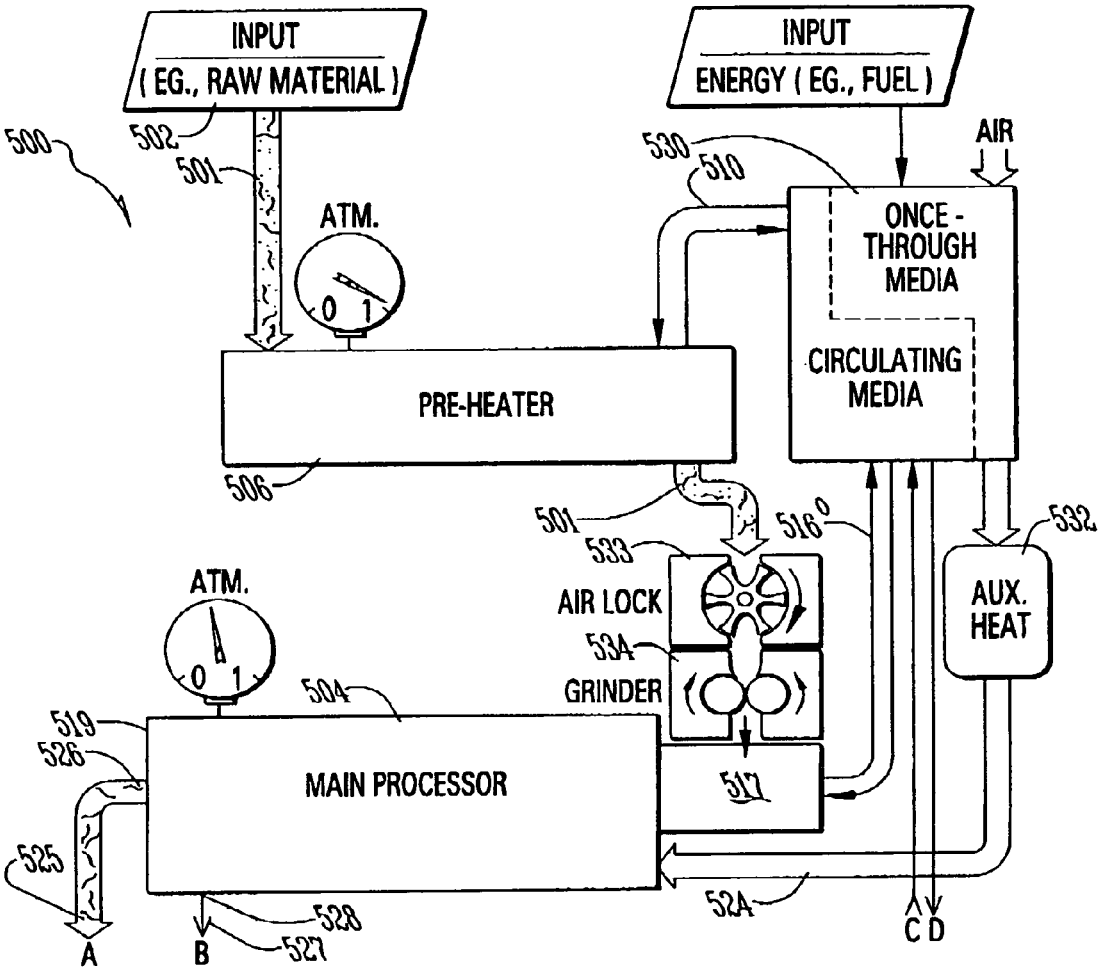
Figure 1B:
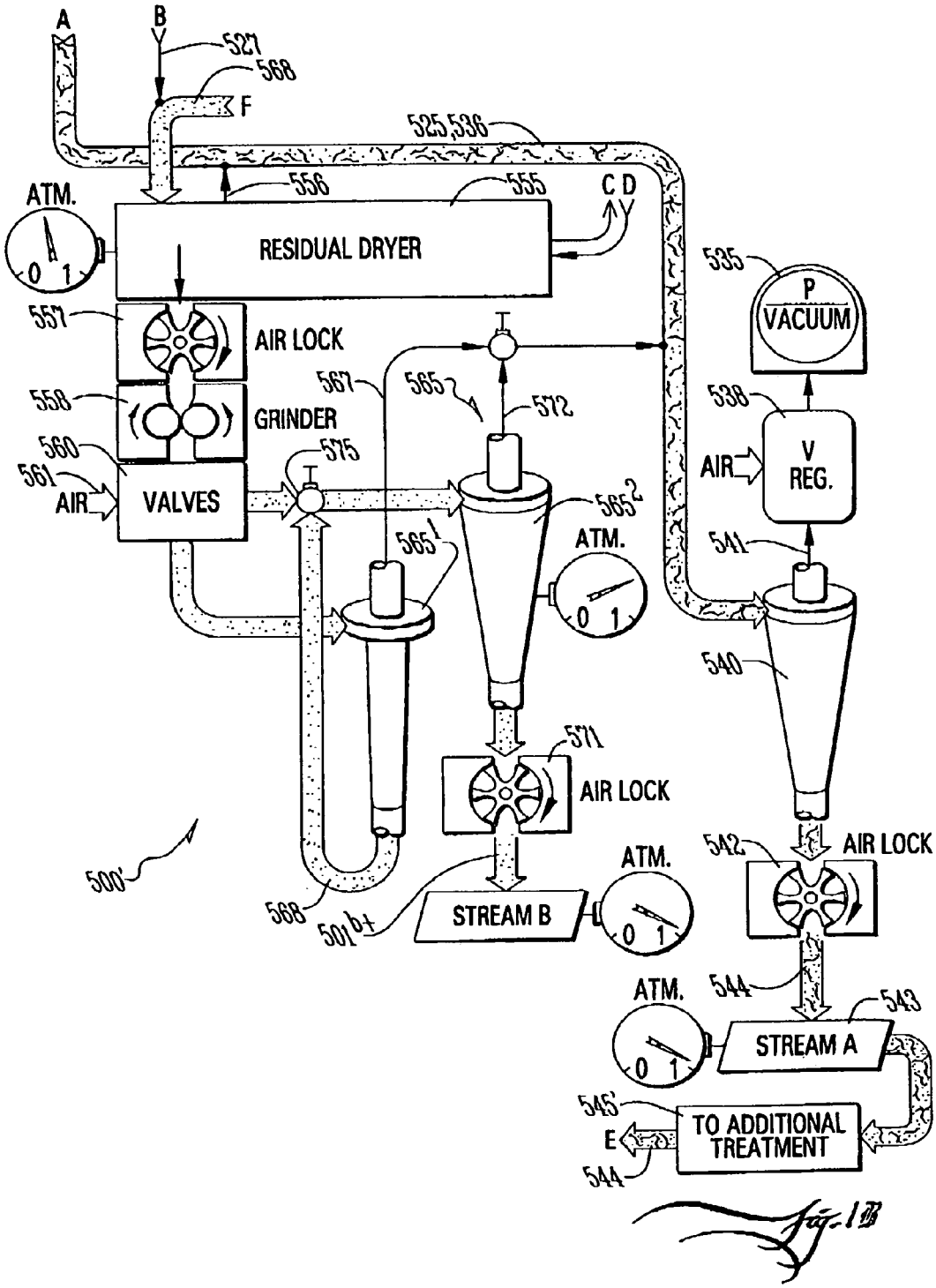

FIGS. 1A and 1B tile together to form a block diagram of a method and apparatus 500 in accordance with the invention for accepting an input 501 of, for example, empty broken egg shells and separating such into membrane and mineral fractions 501$^a$ and 501$^b$ respectively. It is an object of the invention to avoid materially changing the economically valuable constituents of the membrane fraction 501$^a$.

At some original time a supply of raw input material is fed to the apparatus 500. For example, bulk shipment of empty broken egg shells can be trucked in on roll-off containers, and then unloaded (as a dump truck) into some sort of bin or hopper 502 or the like, such as an auger-scoured U-trough. What is preferred is if the receiving bin, hopper or auger-scoured U-trough 502 and the like is adaptable to discharge the raw input material in a measured stream 501 to initial stages of the inventive method and apparatus.

In a supporting role to a main processor 504, preferably an initial stage comprises a pre-heater 506. By way of background, the stream 501 of input material will normally contain a substantial amount of moisture, it being an object of the invention to evaporate that away to the extent practicable. However, it is an aspect of the invention that the pre-heater 506 does not actually perform any significant drying function. Instead, it is preferred if pre-heater 506 merely pre-heats the material stream 501 and thereby readies it for flash steam production in the main processor 504 as well as drying in various stations in that follow the pre-heater 506, including without limitation the main processor 504.

Figure 3:
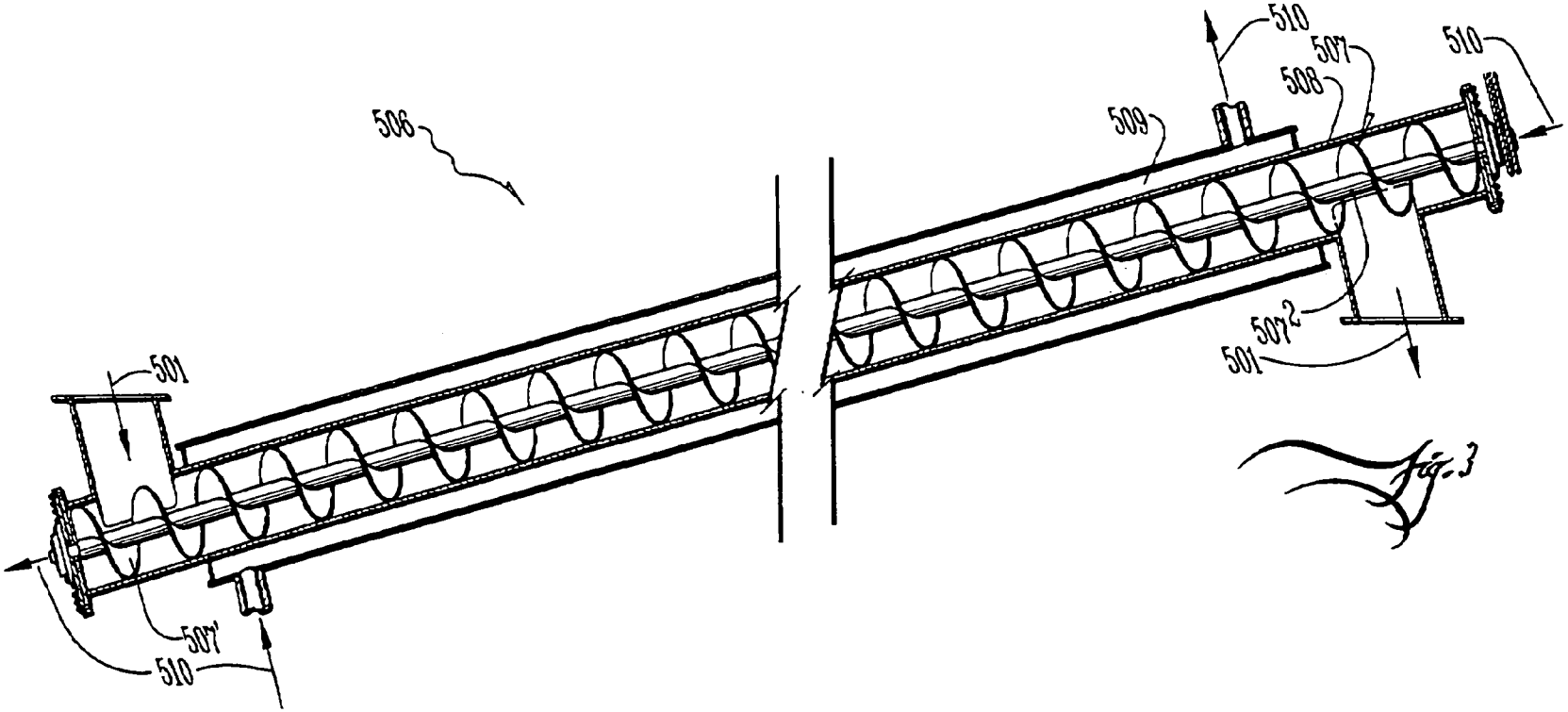
FIG. 3 is an elevational view, partly in section, of an example apparatus for carrying out the activities of a "pre-heater" as referenced in FIG. 1A.

With reference to FIG. 3, a non-limiting example of a pre-heater 506 might comprise auger 507 having a helical screw 507' formed around a hollow drive shaft 5072 and situated inside a tight-fitting duct 508. It is preferred if the tight-fitting duct 508 has a jacket to allow circulation of a thermal fluid 510 such as and without limitation hot water or steam. It is additionally preferred to circulate the thermal fluid 510 through the hollow drive shaft 507$^2$.

The output of the pre-heater 506 comprises the material stream 501 of course except warmed. This is inputted (or introduced) into the aforementioned main processor 504. As an aside, if the main processor 504 stands relatively high up off the ground, then the pre-heater 506—since it has the construction of a transfer auger—can be inclined to accommodate any elevation difference.

Figure 2:
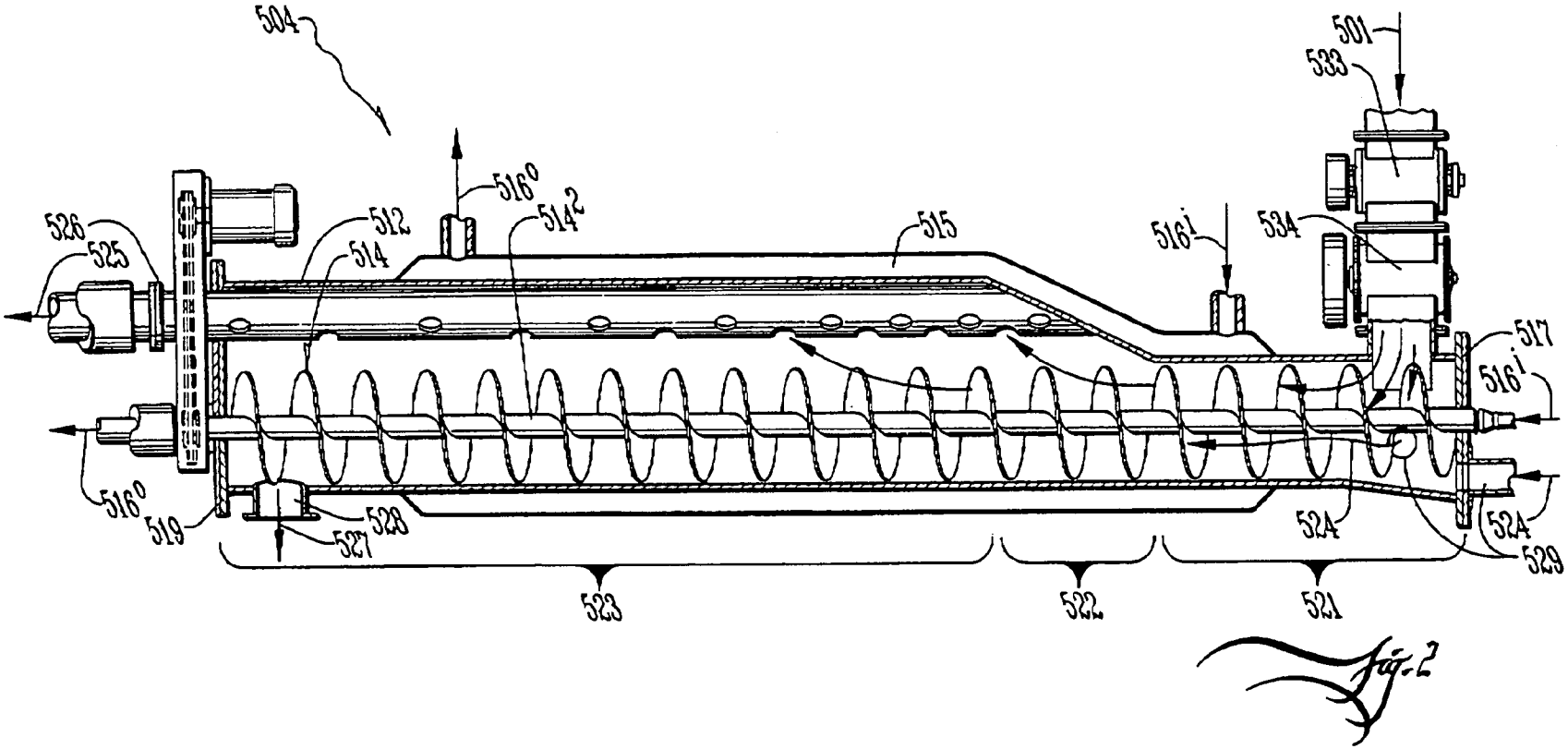
FIG. 2 is an elevational view, partly in section, of an example apparatus for carrying out the activities of a "main processor" as referenced in FIG. 1A.

With reference to FIG. 2, a preferred construction for a main processor 504 comprises a multi-sectioned tubular vessel 512 arranged horizontally and housing an internal auger 514. Since the main processor 504 is also heated, preferably the vessel 512 is surrounded by a jacket 515 for circulating an appropriate thermal fluid 516$^{i}$, 516$^{o}$ (eg., steam). The auger 514 preferably has a hollow drive shaft 514$^{2}$ for circulation of a thermal fluid 516$^{i}$, 516$^{o}$ through it as well.

More generally, the vessel 512 of the main processor 504 preferably extends between an introduction end 517 and an axially-spaced away discharge end 519. The vessel 512 can be reckoned as having at least three distinct zones or sections along its axial length. An original zone or section 521 originates at the introduction end 517, and the vessel 512's wall in this zone or section is characterized as surrounding the auger 514 as a tight-fitting duct. That is, the auger 514's outer periphery would virtually scrape the vessel 512's wall in this tight-fitting duct section 521.

The tight-fitting duct section 521 changes into a flaring zone or section 522. In turn, the flaring section 522 changes into a final zone or section 523 that comprises an over-sized duct section (eg., 523). All three sections 521–23 are arranged to rest flat on a common base elevation. That way, the internal auger 514 is situated on the bottommost elevation in not just the tight-fitting duct section 521 but also the flaring and over-sized duct sections 522 and 523. Accordingly, the flaring and over-sized duct sections 522 and 523 form a relative trough for the main processor 504's auger 514. The preferred arrangement for the flaring section 522 has it flaring along its extension from the tight-fitting duct section 521 to the over-sized duct section 523 by a straight progression of increasing-size circular hoops according to a linear slope. Nevertheless it could be configured differently and still transition between the tight-fitting and over-sized duct sections 521 and 523, as by a curving slope whereby it might flare like (very approximately) a ram's horn.

An example vessel might measure without limitation about 4.8 meters (sixteen feet) long, of which about 1.2 meters (four feet) comprises the tight-fitting duct section, 0.6 meters (two feet) comprises the flaring middle section and the remaining 3.0 meters (ten feet) consists of the over-sized cylindrical section. The tight-fitting duct section 521 preferably has an inside diameter of about a fifty cm (19½ inches I.D.). The over-sized cylindrical section preferably has an inside diameter of about a ninety cm (thirty-six inches I.D.). Since the auger 514 preferably extends through all three sections 521–23, it will only scrape (virtually) 360$^{o}$ of the vessel 512's wall in just the tight-fitting duct section 521. Within the flaring and over-sized duct sections 522 and 523, the auger 514 merely imperfectly scrapes the bottoms of these sections 522 and 523 as if sitting in an over-sized trough or the like, there being varying lateral and overhead clearance in these larger sections 522 and 523.

An example auger 514 might have a twenty-three cm (nine inch) pitch relative to an about fifty cm outside diameter (19½ inches O.D.). It may be noted that this corresponds to a fairly "fine" thread, it being more customary in the design of augers to make pitch equal to outside diameter. If it assumed that the auger 514's "effective" material-handling length does not truly span end-to-end in the vessel 512, but originates and terminates about thirty cm (one foot) away from the introduction and discharge ends 517 and 519 respectively, then the auger 514's effective length might be assumed (very approximately) to measure something like 4¼ meters (fourteen feet) long. Correspondingly, given the auger 514 having the foregoing pitch and effective length, and if driven at about five r.p.m., then the auger 514 very generally pushes material across its effective length in about 3½ minutes. In contrast, the introduced input material 501 is confined to the tight-fitting duct section 521 for only about ¾$^{ths}$ a minute or so.

The tight-fitting duct section 521 is adapted to receive the warm input material 501 continuously along at the same time with a continuous injection or influx of a "pneumatic carrier," ie., a hot dry clean gas 524. The vessel 514's discharge end 519 is adapted to discharge (i) a "pneumatic stream" 525 out a vacuum port 526 as well as (ii) discharge a nearly-dry residual stream 527 out a drain 528. FIG. 2 shows the pneumatic carrier 524 being introduced in a pair of inlet ports 529 that are located at relatively low elevations on the introduction end 517 or tight-fitting duct section 521's sidewall respectively. In contrast, the input material 501 is introduced from directly overhead. This arrangement helps promote mixing.

Additionally, FIG. 2 shows the vacuum port 526 to comprise a perforated tube providing numerous suction ports along the axial extension of the over-sized duct section. However, this is illustrated this way for convenience of illustration and it is preferred that the vacuum port 526 is alternatively configured as simply an aperture in the discharge end 519. In other words, it is preferred if such a perforated tube is omitted.

Given the foregoing, it is an aspect of the invention that the vessel 512 is held under a partial state of vacuum. FIGS. 1*a* and 1*b* include various mock vacuum gauges to provide a relative comparison of the level of vacuum in the various vacuum components of the apparatus 500. A suitably high power source of vacuum will be described more particularly below. Hence the vessel 514 has the following streams entering and, after interaction, exiting it. The introduction end 517 and the section 521 adjacent thereto accept(s) a wet or moist, warm stream of pre-heated input material 501 as well as a stream of a hot dry clean gas 524. By the time the gas or "pneumatic" carrier 524 exits the vessel as predominantly through the vacuum port 526 it additionally carries with it a vapor content that has been vaporized out of the input material 501, as well as a weight fraction of suspended, entrained or waftable materials. For convenience of terminology, this circumstance is referred to as the "pneumatic conveyance" of such suspended, entrained or waftable materials, regardless if the conveying gas is not truly air but something else. The vapor content substantially comprises water vapor but perhaps as well as lesser amounts of other vapors of vaporizable constituents. Whereas fresh egg shell membrane naturally has an inherent water content, it is presumed that much of the water in the input stream 501 was introduced by rinsing and/or washing operations at the egg breaking plant during a yolk and albumen recovering process.

Again, the vessel 512 admits the input material 501 as well as an intake stream of a pneumatic carrier 524 preferably comprising a hot and substantially clean and dry gas. The vessel discharges a pneumatic stream 525 out through the vacuum port 526 comprising not only the pneumatic carrier but also a vapor fraction as well as a weight fraction of entrained, suspended or waftable materials. The vessel 512 additionally discharges a minuscule residual stream 527 out through the drain 528.

A preferred source of the "pneumatic carrier" 524, or in other words a hot dry clean gas, is the flue gas exhaust from a propane boiler 530 that might be utilized to produce the steam (or whatever hot thermal circulating fluid 516 might be alternatively used) for the thermal components of the inventive method and apparatus. At times when the boiler 530's propane combustion is switched OFF, the intake gas might be alternatively obtained from pre-heated air as simply as by suctioning it in from the ambient environment (eg., the room) through an auxiliary heat exchanger 532 prior to introduction into the main processor 504's vessel 512. The heat source for auxiliary heat exchanger 532 might comprise without limitation any of the following. That is, the heat source might comprise electric resistance heaters. Alternatively, it might comprise the steam condensate return 516$^{o}$ from the main processor 504 (in contrast to the steam input 516$^{i}$). The outflow of the pneumatic stream 525 is suctioned through the vacuum port 526, as previously stated, and this suction is ultimately pulled by a large vacuum pump 535.

In order to introduce the wet and warm input material 501 into the vessel 512 without losing the vacuum, it is introduced by way of through an air-lock gate 533. An example air-lock gate has body forming cylindrical cavity and sandwiched between opposed flat end-plates. The cavity houses a vane gear that is driven to rotate such that material 501 introduced in the top falls into the vanes, and is rotated by the vanes to drop out through an open bottom. The vanes form a seal by scraping between the opposed flat end-plates as well as scraping past cavity's cylindrical sidewall.

It is preferred to grind up the output of the air-lock gate 533 in order to break apart clumps as well as shatter the mineral fraction 501$^{b}$ into shards or bits and the like. An example grinder 534 comprises a flailing-type grinder, as having counter-rotating grinding wheels, each which bristles with an array of spokes. The grinder 534 is driven up to speeds of eight-hundred and fifty r.p.m.

Coordinating the operating temperatures and pressures for thermal and vacuum components of the method 500' in accordance with the invention requires compromises among competing factors. Generally, (i) higher temperatures result in shorter flashing and/or drying times as well as more compact equipment but risk "over-cooking" the valuable membrane 501$^{a}$, while (ii) ultra-low vacuum pressures enable flashing and/or drying at cooler temperatures but risk physical damage to the membrane 501$^{a}$.

The main processor 501 can be reckoned as, to use terms of art, a hybrid of a rotary dryer and a flash dryer. The tight-fitting duct section 521 appears to be constructed predominantly in the fashion as a rotary dryer, with its heated walls and auger 514. In contrast, the flaring and over-sized duct sections 522 and 523 operate predominantly according to the principles of a flash dryer, in which suspended particles are pneumatically conveyed in the hot pneumatic carrier 524. To help the pneumatic carrier 524 syphon up particles, the auger 514 is preferably enhanced with short stubby flights (not shown) distributed over at least that much of the auger 514 extending through the tight-fitting duct section 521. Such stubby flights agitate and tumble the non-suspended material (eg., 527) by means of this cut-and-fold construction, in order to prevent clumps and/or hard crusts from forming.

The main processor 504 is operated under a vacuum to both enable vaporization as well as formation of flash steam to occur at a relatively cooler temperature. Water at sea level boils of course at 100° C. (212° F.). However, at ½ an atmosphere (fifteen inches of mercury), water boils at 80° C. (~180° F.). Indeed as pressure is depressed further, water boils at even lower temperatures still. Hence it is possible to produce flash steam and/or dry materials at relatively cool temperatures. However, there is a hazard for operating at too low of a vacuum pressure. Apparently, excessive flash-steam production or else other phenomena (eg., like excessive turbulence) rips the membrane fraction 501$^{a}$ to shreds, making it not only more difficult to separate, but also more susceptible to "over-cooking" or other forms of degradation.

Again, perhaps the excessive ripping is due to too much "flash steam" forming inside the membrane 501$^{a}$. The concepts of "flash steam" production and "flash drying" are different concepts despite being denominated with the common term "flash." As described above, flash drying is a process by which material dries while suspended in a hot pneumatic carrier, as this promotes mixing and efficient heat transfer. The discharged pneumatic stream 525 carries away ~100% of the water vapor produced in the main processor 504:—of that 100%, perhaps well over 95% is the produced by flash drying.

In contrast, the production of "flash steam" is a different phenomenon. And while it accounts for only a minority percentage of the water vapor produced in the main processor 504, it is an important phenomenon because what it contributes to the membrane fraction 501$^{a}$ casting off or shaking loose from the adhered mineral fraction 501$^{b}$.

Briefly, when hot water under pressure is released to a lower pressure, part of it is suddenly evaporated, becoming what is known as "flash steam." The basic physics behind this includes that, when water is heated at atmospheric pressure, its temperature rises until it reaches 100° C. (212° F.), the highest temperature at which water can exist at atmospheric pressure. Additional heat does not raise the temperature, but converts the water to steam. The heat absorbed by the water in raising its temperature to the boiling point is called "sensible heat." The heat of water at the boiling temperature is called the heat of saturated condensate. Then heat required to convert water at boiling temperature to steam at the same temperature is called "latent heat."

Note that at pressures lower than atmospheric (eg., vacuum pressures), water boils at relatively lower temperatures. Conversely, the value of latent heat slightly (very slightly) increases with lower pressures, or in other words, slightly (again, very slightly) greater amounts of heat are required to change saturated condensate to steam at the lower pressures.

If saturated water at atmospheric pressure is introduced into a partial vacuum, a certain amount of sensible heat is released. This excess heat will be absorbed in the form of latent heat, causing part of the water to "flash" into steam. To illustrate with real world values, saturated water at atmospheric pressure has a heat content of about 100 kcal/kg (180 Btu/lb). If this condensate is introduced into a ½ atmosphere vacuum, its heat content instantly drops to 82 kcal/kg (147 Btu/lb). The surplus 18 kcal/kg (33 Btu/lb) evaporates or flashes a portion of the condensate into steam. The percentage that will flash to steam can be computed using the formula:

$$\%\ \text{flash steam}=[(S_h-S_1)\div H]\times 100,\ \text{where}$$

$S_h$=Sensible heat in the condensate at the higher pressure before discharge;

$S_1$=Sensible heat in the condensate at the lower pressure to which discharge takes place; and H=Latent heat in the steam at the lower pressure to which the condensate has been discharged.

Given that the latent heat of steam for ½ atmosphere is about five-hundred and fifty kcal/kg (one thousand Btu/lb), then the percentage of flash steam computes to about 3⅓ percent. Note that 18% flash steam is about the best percentage possible from atmospheric even if discharged into an ultra-low pressure vacuum. It is an aspect of the invention to utilize the phenomenon of flash steam to promote membrane 501$^{a}$ and mineral 501$^{b}$ detachment by introduction of the pre-heated material 501 into the vacuum of the main processor 504. However, it has been discovered that is amply possible to overdo the flash steam phenomenon in an excessively low-pressure vacuum, because that too much flash steam production seems to shred apart membrane 501$^{a}$, or do something else bad.

As for membrane textural and structural properties, for a preferred market it is desired to achieve the consistency of fresh rose petals. For an alternate preferred market, it is acceptable to produce an end-result which is tougher and more compact (eg., perhaps because proteins have shortened). Although, this tougher and more compact end-result will ordinarily have a longer shelf life and is more immune to growing pathogens, it also is probable that the delicate molecules are changed more than with the rose petal end-result. It is preferred to avoid rendering the membrane until texturally and structurally it resembles a brittle cereal flake (eg., Post® Toasties® or Kellogg's® Corn Flakes®, among others). Moreover, rendering the membrane to ash is simply a useless and a disastrous result.

Hence the goal with the pre-heater 506 is to warm up the raw input material 501 to a temperature above what corresponds to the boiling point for the vacuum pressure inside the main processor 504, without actually taking it over 100° C. (212° F.), the boiling point for atmospheric pressure. For example, if the vacuum pressure in the main processor 504 is a ⅓$^{rd}$ an atmosphere (ten inches of mercury), then water will boil not at 100° C. (212° F.) but 75° C. (~165° F.). Hence the goal with the pre-heater 506 is to warm up the raw input material 501 to as much over 75° C. (~165° F.) that is deemed acceptable in view of what the membrane 501$^{a}$ can withstand, without needless to say going over 100° C. (212° F.). In other words, it is not an object of the pre-heater 506 to boil moisture out of the raw input material 501 at this stage. Thus the pre-heater 506 with its heated walls 508 and auger shaft 507$^{2}$ gently warms and stirs the material 501 in transit. Preferably the pre-heater 506's auger screw 507$^{1}$ also has a cut-and-fold arrangement for tumbling the material 501 on its way to being introduced in the main processor 504. This promotes disintegration and avoids clump-formation as well as avoids any input material 501 being in direct contact for too long with the hot walls 508 or auger shaft 5072. It also promotes uniform temperature distribution throughout the material 501 and so eliminates hot and/or cold spots.

Agitating and tumbling also affords an operator to get by with a relatively "cooler" pre-heater 506. That way, the pre-heating can take place longer and more slowly as well as eliminate tricky careful timing of the residence time in the pre-heater 506. Indeed, the thermal fluid 510 is preferably not steam in all cases but hot water. The main processor 504 is where control over residence time is supervised carefully. Whereas an operator likely has manage conditions in the main processor 504 fairly to very closely, at least the operator will not be as distracted by things with the pre-heater 506 because it does not require the same kind of micro-management.

When the pre-heated material 501 is introduced into the main processor 504, it is first ground up and then encounters a transit time of about ¾$^{ths}$ a minute or so in the tight-fitting duct section 521. Here if not more immediately sooner is where presumably the production of flash steam occurs. It is an object of the invention that as soon as the input material 501 enters the vacuum, flash steam production is underway as immediately as practicable.

Another reason for pulling the main processor 504 under a vacuum is that such affords the opportunity to use a relatively cooler pneumatic carrier 524 (eg., the flue gases or auxiliary-heated air) for flash (or more descriptively, pneumatic-conveyance) drying purposes. Again, using the same values and equation above, only about 3⅓ percent of the moisture content in the introduced input material 501 is available for flashing, and that assumes that the input material measures about 100° C. (212° F.) hot. If cooler, then less will flash. Whatever percentage indeed results from flash steam production, the rest of the moisture content will have to be vaporized through the process of flash drying or, in more descriptive terminology, drying during pneumatic conveyance.

The choice over the how hot and how abundant (eg., what flowrate) to make the pneumatic carrier 524 involves a compromise among competing factors. The pneumatic carrier 524 should be sufficiently hot and abundant to promote pneumatic-conveyance drying in the 3½ minute residence time in the main processor 504 as efficiently as practicable. Of course the pneumatic carrier 524's temperature will drop as a result, and the drop will be a function of the heat accepted by the pneumatic carrier 524 against the latent heat of vaporization of the vaporizing components. If the pneumatic carrier 524 is more abundant, it can be introduced cooler and accept as much heat as if it were hotter but less abundant. Hence the pneumatic carrier 524 should be as "cool" and abundant as an operator can get away with to both achieve flash (pneumatic-conveyance) drying and avoid "over-cooking." The peripheral edges of the membrane petals present the greatest risk of over-cooking, even if the centers desirably retain a rose-petal consistency.

Although much of the water content of the input stream 501 is presumed to come from rinsing and washing operations at the egg breaking plant, there was always inherently some moisture contained in the gas-exchange pores of the egg shells which extend through both the membrane and mineral layers 501$^{a}$ and 501$^{b}$.

The vacuum produces a phenomenon, it believed to be flash steam production, which contributes significantly to the manner that membrane 501$^{a}$ casts off or shakes free from the attached mineral 501$^{b}$. If the vacuum application is done just right, essentially all the weight fraction of the membrane will be detached from mineral. Additionally, most the membrane will have a desired petal size measuring about 1¼ cm outside diameter (~½ inch O.D.). However, trial and error finds that if the vacuum pressure is too low, then the membrane fraction comes out torn to shreds.

Presumptively flash steam is produced inside flakes of membrane, as inside the gas exchange pores, causing the flakes to swell, and perhaps purge themselves of attached shards and grains of mineral. In contrast, if there is little or no flash steam production (eg., the introduced material 501 is introduced too cold), then perhaps vapor in the pores never forms quickly enough to swell the membrane, but simply leaks out. In contradistinction, if the main processor 504's vacuum pressure is pulled too low, then perhaps flash steam forms too explosively, and thereby explodes the membrane. Or perhaps that last problem is really one of turbulence. Somehow something tears the membrane to shreds if the main processor 504's vacuum pressure is too low.

An example of operating conditions includes the following. A target throughput of empty broken eggshells 501 preferably is processed through at a rate of about twenty-three hundred kg (~five-thousand lbs) per hour. The pneumatic carrier 524 is introduced into the main processor 504 between about 120° C. and 130° C. (~250° F. and 270° F.). The thermal fluid 516 circulating through the main processor 504's thermal components is targeted to keep the vessel 512's walls and auger at about 90° C. (~200° F.). To achieve this, it is preferred to circulate pressurized steam at about seven atmospheres gauge. The flowrate of the pneumatic carrier 524 is unregulated before introduction, and in fact is a product of whatever results from regulating the vacuum pump 535 to hold the main processor 504's pressure at about a ½ atmosphere vacuum (~fifteen inches of mercury). Hence the pneumatic carrier 524's flowrate is as much as the vacuum pump 535 can handle under the circumstances. A flowrate at the inlet has been measured corresponding to about three-hundred cubic meters per minute (~twelve-thousand c.f.m.). In spite of the heat supply, the pneumatic stream 525 exiting the main processor 504 goes at about 60° C. (~140° F.).

It is an option to hang the main processor 504 from electronic scales (not shown). An automation system might be arranged for controlling introduction of the input material 501 into the main processor 504. If the scales measure changes in weight with the main processor 504 (ie., due to imbalance of the rates of material 501 and 524 in against material 527 and 526 out), the automation system might engage in proportionate control over, among other options, the rate of feed of input material 501 in order to level off imbalance.

Attention will now be turned to the treatments the pneumatic stream 525 undergoes after exiting the main processor 504. By way of background, the vacuum pump 535 is the ultimate end-of-the line for the pneumatic carrier 524 as well as the vapors and perhaps the finest of particulate matter. It is not known perfectly what the finest particulate matter comprises but it is guessed to include some tiny shreds of membrane, some ultra-fine mineral matter, and perhaps other ultra-fine matter such as dried albumen dust or the like. A trunk (eg., main) vacuum line 536 extends from an origin at the main processor 504's vacuum port 526 to a termination at the vacuum pump 535. The vacuum pump 535 pulls most immediately, however, on a regulator valve 538.

The regulator valve 538 provides control over the level of vacuum pulled throughout the rest of the system 500. By way of background, large vacuum pumps are not only costly but also typically rated for just one working load only. They simply lack adjustment features for regulating the working load. Hence the chosen vacuum pump has a duty rating in excess of what is needed, and the actual operating pressures in the system 500 are regulated to what is wanted by custom regulating valves 538 (and also 560, described more particularly below). Hence FIG. 1B shows the vacuum pump 535 pulling directly on a primary regulator valve 538. The primary regulator valve 538 mixes streams being pulled from the system (eg., 525 which evolves into stream 541, as well as without limitation stream 572 which is described more particularly below) with bled in air coming directly from the ambient environment (eg., the room). That way, the regulator valve 538 bleeds in a little room air in order to dilute the strength of the vacuum pump 535.

Situated in between the main processor 504 and the vacuum pump 535 is at least some form of particle separation system (eg., as indicated generally by 540). An example comprises a cyclone separator 540. It operates to divide the received pneumatic stream 525 into two, namely, one stream 541 being vented out the exhaust pipe and onward to the vacuum pump 535 and another stream 544 comprising substantially particles of membrane petals 501*a* and a residual particle stream 568 substantially of mineral 501$^b$.

The vent stream 541 comprises the pneumatic carrier 524, vapors and perhaps the finest of particulate matter. The particle stream 544 drains out the bottom of the cyclone separator 540 and transits through an air-lock gate 542 in order to preserve the vacuum in the cyclone 540 as well as the main processor 504. At this point, the particle stream 544 empties out into or onto some collection or conveyor system 543. An example conveyor system 543 comprises a transfer auger. It optionally transports the particle stream 544 to an optional supplementary separation system 545'. The pneumatic stream 525 exiting the main processor 504 carries away both about 100% weight fraction of the membrane 501*a* content of the input 501, as well as very nearly 100% weight fraction of the input 501's total mineral 501$^b$ content. Although both are conveyed together in the pneumatic stream 525, at least the membrane and mineral fractions 501$^a$ and 501$^b$ are liberated from each other, or that is detached.

Hence the particle stream 544 likewise comprises nearly all of the membrane and mineral fractions 501$^a$ and 501$^b$ that are recoverable. Since the two fractions are at least liberated or detached from each other (or if not truly detached, then at worst they are only loosely attached such that a little mechanical shaking will finish the job), separation is achieved by a supplementary separation system 545'. Hence what drains out the pneumatic stream 525's cyclone 540 is a membrane and mineral 501$^a$ and 501$^b$ mixture that merely travels together but is otherwise substantially detached from one another. This membrane and mineral 501$^a$ and 501$^b$ mixture are henceforth fed to the supplementary separation system 545'.

Figure 4:
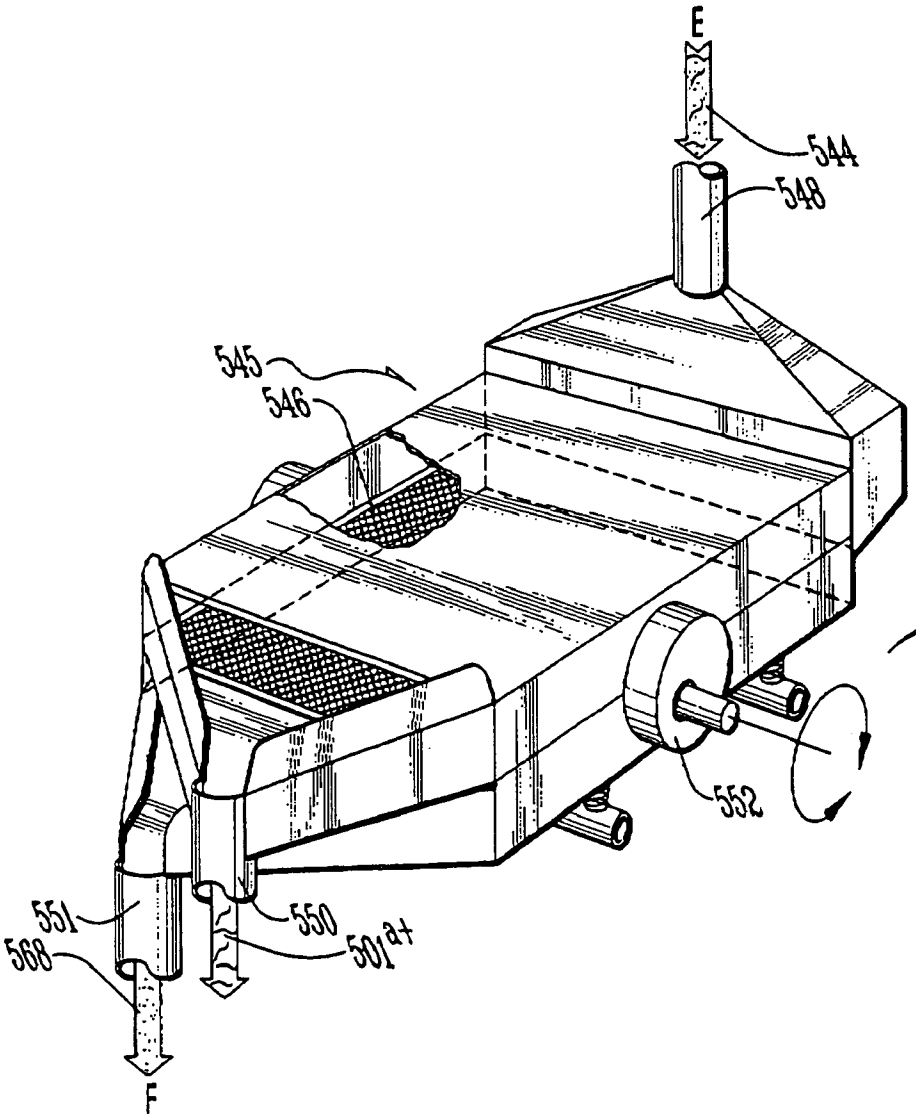
FIG. 4 is a perspective view, with portions broken away, of an example and optional apparatus for carrying out the "additional treatment" activities to "Stream A" and as referenced in FIG. 1B.

FIG. 4 shows an example supplementary separation system comprises without limitation a vibratory screen 545. The vibratory screen 545 comprises a wire-mesh screen 546 having an upper product-carrying surface extending axially between an infeed end 548 and a discharge end formed with dual discharge drains 550 and 551. The wire-mesh screen 546 has a pore size chosen for supporting membrane petals but allowing mineral dust to sift through and drain out the lower drain 551 for the sifted material. The product-carrying screen 546 is preferably vibrated by a rotated transverse eccentric 552. It periodically "thumps" the product-carrying screen 546 run and thereby gives the membrane and mineral 501$^a$ and 501$^b$ mixture a bumpy ride, like a trampoline. The screen 546 is mounted on a tilt such that membrane petals bounce their way from the infeed end 548 to the discharge 550.

Consequently, a continuous feed of membrane and mineral 501$^a$ and 501$^b$ mixture is deposited on the infeed end 548 of the screen 546, thumped continuously from underneath on the transit across to the dual discharges 550 and 551 wherein during that time the mineral powder continuously shakes out and sifts through wire-mesh screen 546. Accordingly, the membrane discharge 550 discharges a substantially pure stream of membrane petals 501$^{a+}$.

Referring back to the main processor 504's drain 528, what exits out there is a minuscule residual stream 527. Albeit a stream of powder-sized particles for the most part, the minuscule residual stream 527 is deemed insufficiently dry at this stage. Hence the minuscule residual stream 527 is introduced into a residual dryer 555.

Referring back to FIG. 5, the residual particle stream 568 comprises a sizable stream (when compared to the minuscule residual stream 527 from the main processor 504) and it too is deemed insufficiently dry and likewise introduced in the residual dryer 555, except through an air-lock gate (not shown) to preserve the vacuum in the residual dryer 555. The combined residual streams 527 and 568 might contain about a 10% weight fraction of the total membrane 501$^a$ content but, better yet, about 100% weight fraction of the mineral 501$^{b}$. The affects of heat and vacuum on the mineral content 501$^{b}$ induced much of it to break up into a grit size of nearly ten micrometers (~three-hundred microns).

The residual dryer 555 comprises an elongated duct carrying a comparably elongated auger wherein the duct sidewall is oversized compared to the auger, having about a fifty percent (50%) larger diameter. In order to achieve optimal drying in the residual dryer 555, clearance is needed. Technically speaking, the residual dryer 555 is more accurately a variety of rotary dryers. Hence a preferred duct has about a forty-five cm inside diameter (eighteen inch I.D.) for an auger having about a thirty cm outside diameter (twelve inch O.D.). The residual dryer 555 is fed the combined residual streams 527 and 568. The residual dryer 555 optionally includes one or more small vacuum ports to keep the vacuum level down in spite of vapor emission from the residuals. Vacuum branch lines 556 link the residual dryer 555 with the vacuum trunk line 536 that extends between the main processor 504 and the pneumatic-stream 525's cyclone 540. What gets suctioned out of the residual dryer 555 may additionally include a small weight fraction of membrane that is worth catching at the pneumatic-stream 525's cyclone 540 to the extent practicable.

The residual dryer 555 is preferably held to the same or comparable vacuum pressure as the main processor 504. Hence the residual streams 527 and 568 are subjected to further drying, and at vacuum, for the transit time through the residual dryer 555. An example residual dryer 555 might further comprise a jacketed duct and hollow auger shaft for circulating a thermal fluid as has been described in connection with the pre-heater 506. The residual dryer 555's output is discharged out a drain and through an air-lock gate 557 in order to isolate the vacuum. The residual dryer 555's output is then ground up by a grinder 558 to promote disintegration of the output to powder.

This dry residual material is fed to a further separation system 565. An example dry residual separation system 565 comprises one or more cyclone separators 565$^{1}$ and/or 565$^{2}$. However, it is preferred if a regulated bleed valve 560 is situated in between the last-mentioned grinder 558 and these one or more cyclone separators 565$^{1}$ and/or 565$^{2}$. The residual dryer 555's discharge air-lock gate 557 does more than just isolate the vacuum pressure inside the residual dryer 555 and main processor 504. It also allows downstream treatments for the dry residual material to likewise be undertaken under a vacuum, but at a different level. Indeed it is preferred to bleed in make-up air at this regulated bleed valve 560 in order to raise the vacuum pressure a little. Hence the main processor 504 and the residual dryer 555 operate at the lowest pressures in the system 500. The treatments to be described next for the dry residual material are also undertaken under a vacuum, but at an intermediate level about halfway between the main processor 504's vacuum pressure and atmospheric. The residual dryer 555's regulated bleed valve 560 also allows an influx of a pneumatic carrier 561 in order that the separation treatments of the further cyclone separators 565$^{1}$ and/or 565$^{2}$ work without choking for absence of a pneumatic medium. In this instance, the pneumatic carrier 561 is truly air, and is simply suctioned in from the local environment (eg., the room). The air is not heated (but filtered), and hence the pneumatic carrier 561 admitted at this point is simply ambient (eg., room) temperature air.

In any event, the dry residual material might be optionally be fed to a fragmenting cyclone separator 565$^{1}$. A fragmenting cyclone separator 565$^{1}$ does at least two jobs. One job is conventional for cyclone separators, and that being separating the input into an exhaust of a pneumatic stream 567 and a drain of relatively-heavier particulate material 568. The other job is to promote further detachment of mineral from membrane and/or disintegration of the mineral into powder.

An example fragmenting cyclone 565$^{1}$ separator has, not smooth conic walls but, paneled walls such as "frustum" having a hexagonal cross-sectional shape. The tangential injection of the dry residual material 568 (and minuscule amounts of 527) smashes against these panels and thereby is likely to promote further dislodging of mineral from membrane and/or disintegration of mineral into powder. The fragmenting cyclone 565$^{1}$ provides a pneumatic exhaust 567 out a top vent as well as a relatively-heavier particulate material discharge 568 through a drain in the bottom.

The pneumatic exhaust 567 of the fragmenting cyclone 565$^{1}$ is ultimately piped back into the vacuum trunk line 536 between the main processor 504 and the membrane cyclone 540. The pneumatic exhaust 567 of the fragmenting cyclone 565$^{1}$ includes the pneumatic carrier 561, vapors, and ultra-fine or ultra-light suspended matter. It may additionally include a small weight fraction of membrane which is worth catching at the membrane cyclone 540 to the extent practicable.

The drain stream 568 of the fragmenting cyclone 565$^{1}$ might be acceptable as complete. If so, it would have to be transited through an air-lock gate in order to preserve the vacuum pressure inside the fragmenting cyclone 565$^{1}$.

Alternatively, as FIG. 1B shows, the drain stream 568 of the fragmenting cyclone 565$^{1}$ might be fed to a residual cyclone separator 565$^{2}$, preferably a smoothly conical one, in order to further complete the syphoning away of ultra-fine and/or ultra-light suspended matter. The residual cyclone 5652 provides a drain stream 501$^{b+}$ of acceptably pure mineral powder. This is a target end-product of the method 500' as is the membrane petal stream 501$^{a+}$ except for different reasons of course. Egg shell mineral is considered an excellent source of highly bioavailable calcium and can also contain worthwhile levels of micronutrients strontium and selenium. Additionally, egg shell mineral is freer of unwanted elements lead, aluminum, cadmium and mercury than other natural calcium sources. The drain stream 501$^{b+}$ from the residual cyclone 565$^{2}$ empties out through an air-lock gate 571, and is collected or conveyed and the like elsewhere. This is the end-of-the line for the mineral fraction 501$^{b+}$.

The pneumatic exhaust 572 suctioned out the vent of the residual cyclone 565$^{2}$ is preferably piped back into the main vacuum trunk line 536 leading into the membrane cyclone 540. It may additionally include a small weight fraction of membrane which is worth catching at the membrane cyclone separator 540 to the extent practicable.

Nowadays the fragmenting cyclone 565$^{1}$ is less and less necessary. Accordingly, a bypass line and valve 575 is included in order to feed the output of the residual dryer 555's regulated bleed valve 560 to the residual cyclone 565$^{2}$, and thus physically isolate the fragmenting cyclone 565$^{1}$.

The membrane recovered by the method in accordance with the invention is useful for other processes not encompassed by the invention for extracting collagen. The membrane provided by the inventive method is substantially if not absolutely pathogen-free. The collagen which can be extracted from the membrane is useful for many end-uses including by way of a non-limiting example for mixing into consumer shampoo products.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A method for detaching apart the membrane and mineral fractions of empty broken egg shells comprising the steps of:

supplying empty broken egg shells, inclusive of a water content, inherently some of which is presumptively contained in the gas-exchange pores of the egg shells that extend through both the membrane and mineral layers thereof;

providing a main processor that operates at a level of vacuum with a configuration being elongated between an introduction end and a horizontally-spaced discharge end, which discharge end comprises a syphon port for syphoning out a pneumatic stream and a vertically-lower drain for outputting a non-suspended residual stream;

at a relatively elevated pressure, pre-heating the empty broken egg shells in order to elevate the bulk temperature to above what corresponds to the boiling temperature for water within the main processor's vacuum level;

introducing the pre-heated empty broken egg shells into the main processor's introduction end whereby a small percentage of the water content flashes into steam, this presumptively promoting the membrane fraction to eject or detach from attached or adhered shards or powder of the mineral fraction; and providing the main processor with a throughput of a hot pneumatic carrier introduced at the introduction end and syphoned out the syphon port for syphoning up and suspending suspension particles from out of the detaching membrane and mineral fractions; as well as providing the main processor with a mechanical conveyor for conveying non-suspending material from the introduction end to the discharge end for draining out the drain.

2. The method of claim 1 further comprising a vacuum source connected to the syphon port in the main processor to suction out a pneumatic stream comprising the pneumatic carrier, vapors, and suspension particles.

3. The method of claim 2 further comprising a separation process between the vacuum source and the vacuum port of the main processor to separate the pneumatic stream into one set of components comprising substantially particle matter including substantially both liberated membrane petals and else shards or powder of the mineral fraction as well as into another set of components comprising variously the pneumatic carrier, vapors and perhaps ultra-fine particulate matter as dried albumen dust.

4. The method of claim 2 wherein the hot pneumatic carrier comprises a hot dry clean gas including hot air or, alternatively, hot flue/exhaust gases from a combustion process.

5. The method of claim 1 wherein the main processor comprises a multi-sectioned tubular vessel arranged generally horizontally between said introduction and discharge ends thereof as well as housing said mechanical conveyor, which comprises an internal auger that comparably extends end to end inside the vessel;

said vessel's sections including a tight-fitting duct section originating at the introduction end and which is characterized as surrounding the auger such that the auger's outer periphery virtually scrapes the vessel's wall in this tight-fitting duct section, and wherein said tight-fitting duct section changes into a flaring section that in turn changes into an over-sized duct section that terminates at the discharge end.

6. The method of claim 1 further includes supplying the main processor with heat comprising circulation of a non-introduced thermal fluid through sealed-out external or internal heat-exchange jackets or passages.

7. Eggshell membrane product liberated from broken empty eggshells in accordance with the method of claim 1.

8. A process line for inputting broken empty eggshells and outputting liberated eggshell membrane product in accordance with the method of claim 1.

9. A method for detaching apart the membrane and mineral fractions of empty broken egg shells comprising the steps of:

providing a main processor that operates at a level of vacuum with a pneumatic-carrier admission port, a spaced-away pneumatic-carrier syphon port, and a drain;

providing the main processor with a through-current of a hot pneumatic carrier admitted in through the admission port and syphoned out the syphon port;

supplying empty broken egg shells, inclusive of a water content, inherently some of which is presumptively contained in the gas-exchange pores of the egg shells that extend through both the membrane and mineral layers thereof;

at a relatively elevated pressure, pre-heating the empty broken egg shells in order to elevate the bulk temperature to above what corresponds to the boiling temperature for water within the main processor's vacuum level;

introducing the pre-heated empty broken egg shells into the main processor, and onto the through-current of the hot pneumatic carrier for mixing therewith, whereby a small percentage of the water content flashes into steam, this presumptively promoting the membrane fraction to eject or detach from attached or adhered shards or powder of the mineral fraction;

suspending in the current of the hot pneumatic carrier suspension particles from out of the detaching membrane and mineral fractions and carrying such out the syphon port; and draining non-suspending residuals out the drain.

10. The method of claim 9 further comprising syphoning the main processor by a suction source, and interposing a separation process between the suction source and main processor to separate the membrane petals and shreds from about all else.

11. Eggshell membrane product acquired from broken empty eggshells in accordance with the method of claim 9.

12. A process line for inputting broken empty eggshells and outputting liberated eggshell membrane product in accordance with the method of claim 9.

13. A method for detaching apart the membrane and mineral fractions of empty broken egg shells comprising the steps of;

providing a main processor that operates at a level of vacuum with a pneumatic-carrier admission port, a spaced-away pneumatic-carrier syphon port, and a material-introduction passage comprising in series a pressure isolation device for introducing material into the main processor while maintaining the level of vacuum in the main processor and then a grinder for grinding the material outputted by the pressure isolation device within the vacuum level of the main processor;

providing the main processor with a through-current of a hot pneumatic carrier admitted in through the admission port and syphoned out the syphon port;

supplying empty broken egg shells, inclusive of a water content, inherently some of which is presumptively contained in the gas-exchange pores of the egg shells that extend through both the membrane and mineral layers thereof;

at a relatively elevated pressure, pre-heating the empty broken egg shells in order to elevate the bulk temperature to above what corresponds to the boiling temperature for water within the main processor's vacuum level;

introducing the pre-heated empty broken egg shells into the main processor through said material-introduction passage including said pressure isolation device and grinder for mixing with said through-current of the hot pneumatic carrier, whereby a small percentage of the water content flashes into steam, this presumptively promoting the membrane fraction to eject or detach from attached or adhered shards or powder of the mineral fraction; and suspending in the current of the hot pneumatic carrier suspension particles from out of the detaching membrane and mineral fractions and carrying such out the syphon port and not non-suspending residuals.

14. The method of claim 13 further comprising suctioning the main processor by a suction source, and interposing a separation process between the suction source and main processor to separate the membrane petals and shreds from about all else.

15. The method of claim 13 wherein hot pneumatic carrier comprises a hot dry clean gas including hot air or, alternatively, hot flue/exhaust gases from a combustion process.

16. The method of claim 13 further comprising withdrawing non-suspending residuals from the main processor by mechanical conveyance thereof to a drain passage equipped with a pressure isolation device for withdrawing the non-suspending residuals out of the main processor while maintaining the level of vacuum in the main processor.

17. Eggshell membrane product acquired from broken empty eggshells in accordance with the method of claim 13.

18. A process line for inputting broken empty eggshells and outputting liberated eggshell membrane product in accordance with the method of claim 13.

19. A method for detaching apart the membrane and mineral fractions of empty broken egg shells comprising the steps of:

providing a main processor that operates at a level of vacuum with a pneumatic-carrier admission port, a spaced-away pneumatic-carrier syphon port, and a material-introduction pressure isolation device for introducing material into the main processor while maintaining the level of vacuum in the main processor;

providing the main processor with a through current of a pneumatic carrier admitted in through the admission port and syphoned out the syphon port;

supplying empty broken egg shells, inclusive of a water content, inherently some of which is presumptively contained in the gas-exchange pores of the egg shells that extend through both the membrane and mineral layers thereof;

at a relatively elevated pressure, pre-heating the empty broken egg shells in order to elevate the bulk temperature to above what corresponds to the boiling temperature for water within the main processor's vacuum level;

introducing the pre-heated empty broken egg shells into the main processor through said material-introduction pressure isolation device and into said through-current of the hot pneumatic carrier for mixing therewith, whereby a small percentage of the water content flashes into steam, this presumptively promoting the membrane fraction to eject or detach from attached or adhered shards or powder of the mineral fraction; and suspending in the current of the hot pneumatic carrier suspension particles from out of the detaching membrane and mineral fractions and carrying such out the syphon port and not non-suspending residuals.

20. The method of claim 19 wherein the activity of syphoning the pneumatic carrier and suspension particles therewith out the syphon port is carried out by syphoning to a suction source, and further comprising the step of disposing a separation process before the suction source in order to separate the membrane petals and shreds from about all else.

21. The method of claim 19 wherein the pneumatic carrier comprises a dry clean gas including air or, alternatively, flue/exhaust gases from a combustion process.

22. The method of claim 19 further comprising applying mechanical conveyance within the main processor to convey the non-suspending residuals toward a drain therefor in the main processor.

23. Eggshell membrane product acquired from broken empty eggshells in accordance with the method of claim 19.

24. A process line for inputting broken empty eggshells and outputting liberated eggshell membrane product in accordance with the method of claim 19.

* * * * *